United States Patent [19]

Sandwall

[11] Patent Number: 4,848,534

[45] Date of Patent: Jul. 18, 1989

[54] DISCHARGE DEVICE FOR HOPPERS

[75] Inventor: Nils Sandwall, Lidingö, Sweden

[73] Assignee: Consilium Materials Handling Marine AB, Enkoping, Sweden

[21] Appl. No.: 124,794

[22] PCT Filed: Mar. 12, 1987

[86] PCT No.: PCT/SE87/00128

§ 371 Date: Nov. 30, 1987

§ 102(e) Date: Nov. 30, 1987

[87] PCT Pub. No.: WO87/05587

PCT Pub. Date: Sep. 24, 1987

[30] Foreign Application Priority Data

Mar. 12, 1986 [SE] Sweden ..... 8601161

[51] Int. Cl.[4] ..... B65G 21/00

[52] U.S. Cl. ..... 198/535; 198/532; 105/247

[58] Field of Search ..... 198/585, 532, 535, 530; 222/528, 556, 526, 531, 532; 105/311.1, 282.1, 250, 247; 239/114, 123, 650

[56] References Cited

U.S. PATENT DOCUMENTS 790,852 5/1905 Piza ..... 222/556 X
2,603,342 7/1952 Martinson ..... 198/532
4,462,520 7/1984 Strehlow ..... 198/532 X

FOREIGN PATENT DOCUMENTS 439621 6/1985 Sweden .
1156974 5/1985 U.S.S.R. .
1576916 10/1980 United Kingdom .

*Primary Examiner*—Robert J. Spar
*Assistant Examiner*—James R. Bidwell
*Attorney, Agent, or Firm*—Young & Thompson

[57] ABSTRACT

A hopper assembly for crushed material such as ore and limestone is provided, comprising a downwardly narrowing hopper having an outlet located at its lower end defined by facing lateral arcuate edges and a discharge chute, the discharge chute including at one end an arcuate portion conforming to the lateral arcuate edges and at another end a straight portion which guides the material discharged from the hopper, the chute including at each lateral edge thereof a deflector plate extending upwardly from the discharge chute positioned at the junction between the straight and arcuate portions, the deflector plates including an upper arcuate edge portion which lies in the same vertical plane as the facing lateral arcuate edges of the hopper and is adjacent thereto, the plate serving to prevent material discharge from the hopper from jamming between the facing lateral arcuate edges of the hopper and the discharge chute.

4 Claims, 1 Drawing Sheet

DISCHARGE DEVICE FOR HOPPERS

The present invention relates to a device in a hopper for crushed material such as ore and limestone, comprising a downwardly narrowing hopper with an outlet located at its lower end with facing circular arcuate edges and a discharge chute, which is mounted to pivot along a circular arcuate path concentric with the circular arcuate lateral edges between a folded-down position for discharging material from the hopper and a folded-up position to prevent material discharge, said discharge chute having arcuate edge portions conforming to the arcuate edges of the hopper and straight edge portions connected thereto.

When such a chute is swung from the open to the closed position the straight portion of the edge of the chute follows a circular arcuate path from a downwardly inclined position to a horizontal position, the straight edge forming the tangent to the arcuate edge of the hopper. A wedge-shaped gap is thereby formed between the edge of the hopper and the straight edge of the chute. Junks of material can jam in this gap and prevent the chute from moving all the way up.

The purpose of the present invention is to achieve a device which prevents junks of material from jamming in the gap between the hopper edge and the edge of the chute when the chute is swung up to close the hopper outlet.

This is achieved according to the invention by virtue of the fact that the chute is provided at each lateral edge with a deflector plate which extends from the transition area between the arcuate and the straight edge portions and into the straight portion, and lies at least essentially in the same plane as the arcuate edge of the hopper with its upper edge proximate thereto.

During the closing movement, the deflector plate sweeps across the underside of the arcuate hopper edge and any junks of material between it and the edge of the chute are pushed away by the front edge of the deflector plate, so that the chute can be moved unimpeded to its closed position.

Figure 2:
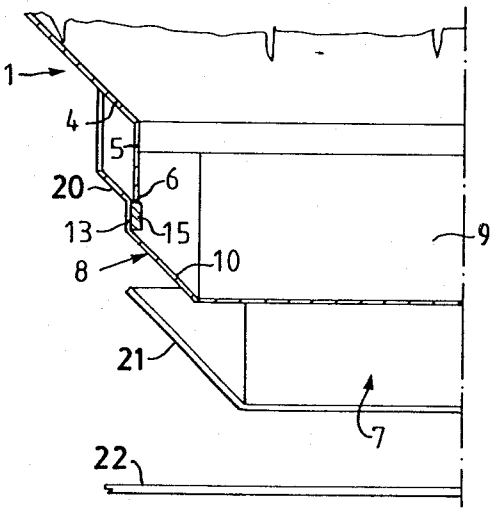
Figure 1:
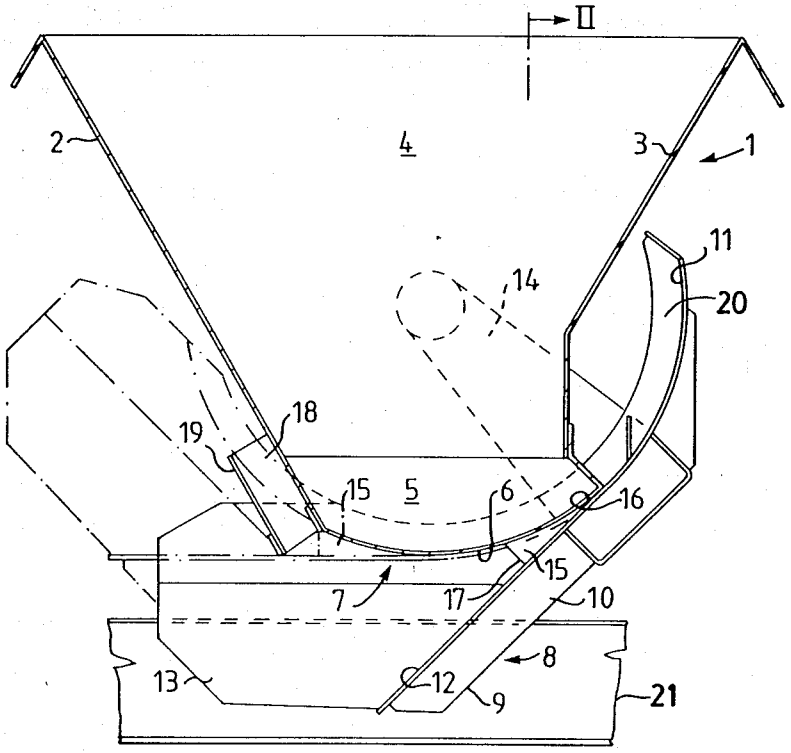

The invention will be described in more detail with reference to an example shown in the accompanying drawings, of which FIG. 1 shows a longitudinal section through a schematically shown hopper with a device according to the invention, and FIG. 2 shows a cross section through one half of said hopper.

1 designates the lower portion of an upwardly open hopper for crushed material such as ore and the like. The hopper has a rectangular cross section with inclined forward and rear walls 2 and 3 and side walls 4 to produce a downwardly narrowing shape. The side walls 4 have lower vertical portions 5 with circular arcuate edges 6, forming the lateral edges of the hopper outlet 7.

A discharge chute generally designated 8, is arranged below the outlet. The chute has a bottom 9 and inclined side walls 10 attached thereto, which have an upper edge with an arcuate portion 11 and a straight portion 12. Vertical wall portions 13 are joined to the inclined side walls 10. The arcuate portion 11 is concentric with the arcuate lateral edges 6 of the hopper. The chute 8 is supported by a pair of supporting arms 14 pivotally mounted in the hopper, which arms are joined to hydraulic operating cylinders (not shown). The pivot center of the supporting arms 14 coincides with the center of the arc of the lateral edges 6, so that the distance between the arcuate lateral edges 6 of the hopper and the arcuate edge portions 11 of the chute are kept constant as the chute is swung.

To prevent junks of material from being jammed between the straight edge portions 12 of the chute and the arcuate lateral edges 6 of the hopper when the chute is swung up, a deflector plate 15 in the form of a wedge is welded at one end of each vertical wall portion 13 of the chute. The deflector 15 has an arcuate upper edge 16 which lies close to the arcuate lateral edge 6, as is clearly shown in FIG. 1. When the chute is swung from the position shown in FIG. 1 with solid lines to the position shown with dashed lines, the front edge 17 of the deflector will push material out of its way so that the chute can be swung unimpeded to its closed position, i.e. with bottom line horizontal. By virtue of the fact that the deflector 15 is wedge-shaped and extends backwards all the way to the arcuate edge portion 11 of the chute, there is no possibility of material being jammed behind the deflector and preventing the chute from being swung down. Material which is pushed forward by the deflector 15 when the chute is swung up can if needed be pushed into a gap 18 between the front wall 2 of the hopper 1 and a plate 19.

The FIGS. also depict an endless material conveyor belt 21, 22 with 21 being the upper portion of the belt and 22 being the return portion of the belt. The arcuate upper flange portion 20 of the discharge chute is also depicted.

I claim:

1. A hopper assembly for crushed material such as ore and limestone, comprising a downwardly narrowing hopper having an outlet located at its lower end defined by facing lateral arcuate edge portions, a discharge chute being mounted at said lower end of said hopper in a manner which permits said discharge chute to pivot along an arcuate path concentric with said facing arcuate lateral edge portions of said hopper, said discharge chute pivotable between an open material discharging position and a closed position which prevents material from being discharged from said hopper, said discharge chute including at one end an arcuate portion conforming to said lateral arcuate edge portions of said hopper outlet and at another end a straight portion which guides the materail discharged from said hopper, said discharge chute including at each lateral edge thereof a deflector plate extending upwardly from said discharge chute and positioned at the junction between said straight and arcuate portions, said deflector plates including an upper arcuate edge portion which lies in the same vertical plane as said facing lateral arcuate edge portions of said hopper outlet and adjacent thereto, said plates serving to prevent material discharged from said hopper from jamming between said facing lateral arcuate edge portions of said hopper outlets and said discharge chute as well as to assist in the removal of material from said outlet of said hopper during movement of said discharge chute to a closed position.

2. The assembly of claim 1 wherein said deflector plates are wedge-shaped.

3. The assembly of claim 1 wherein said hopper further includes at its lower end a plate transverse to said lateral edges fixed to an outer surface of and spaced from said hopper, said fixed plate having a lower edge which is adjacent said straight portion of said discharge chute when said discharge chute is in the closed position.

4. The assembly of claim 1 wherein said discharge chute is supported by a pivot arm attached to said hopper, said pivot arm pivoting about an axis coinciding with the center of arc of said lateral arcuate edge portions of said hopper.

* * * * *